US007265721B2

(12) United States Patent
Fujii et al.

(10) Patent No.: US 7,265,721 B2
(45) Date of Patent: Sep. 4, 2007

(54) PORTABLE TERMINAL APPARATUS

(75) Inventors: Shigehiro Fujii, Kato (JP); Yoshihiro Hirabayashi, Kato (JP); Katsumi Adachi, Kato (JP); Ken-etsu Furuki, Kawasaki (JP); Takahiro Shin, Kawasaki (JP); Yoshihiro Ono, Atsugi (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/935,221

(22) Filed: Sep. 8, 2004

(65) Prior Publication Data

US 2005/0225487 A1 Oct. 13, 2005

(30) Foreign Application Priority Data

Apr. 8, 2004 (JP) ..... 2004-114599

(51) Int. Cl.
*H01Q 1/24* (2006.01)

(52) U.S. Cl. ..... 343/702; 343/700 MS

(58) Field of Classification Search ..... 343/702, 343/700 MS, 718, 872, 895, 866; 455/90
See application file for complete search history.

(56) References Cited

U.S. PATENT DOCUMENTS

| | | | | |
|---|---|---|---|---|
| 4,894,663 | A | 1/1990 | Martin et al. | 343/702 |
| 4,942,884 | A * | 7/1990 | Ichinomiya et al. | 607/98 |
| 5,710,987 | A | 1/1998 | Paulick | |
| 6,278,873 | B1 | 8/2001 | Yuiti et al. | 455/351 |
| 6,597,320 | B2 * | 7/2003 | Maeda et al. | 343/718 |

FOREIGN PATENT DOCUMENTS

| | | |
|---|---|---|
| JP | 57-186802 | 11/1982 |
| JP | 7-221822 | 8/1995 |
| JP | 07-321688 A | 12/1995 |
| JP | 11-187096 | 7/1999 |
| JP | WO 0001028 | 1/2000 |
| JP | 2000-045595 A | 2/2000 |
| JP | 2002-341057 | 11/2002 |

OTHER PUBLICATIONS

Search Report dated Nov. 2, 2004.
European Search Report dated Sep. 15, 2006, issued in corresponding European Application No. 04 255 430.3.

* cited by examiner

*Primary Examiner*—Hoang V. Nguyen
(74) *Attorney, Agent, or Firm*—Westerman, Hattori, Daniels & Adrian, LLP.

(57) ABSTRACT

A portable terminal apparatus can improve a communication efficiency while attempting a miniaturization of a housing. The portable terminal apparatus has a housing that accommodates component parts therein. An antenna and a battery are accommodated in the housing. The antenna is arranged so as to surround the battery.

5 Claims, 9 Drawing Sheets

PORTABLE TERMINAL APPARATUS

BACKGROUND OF THE INVENTION

1. Field of the Invention

The present invention relates to portable terminal apparatuses and, more particularly, to a portable terminal apparatus equipped with an antenna.

2. Description of the Related Art

In recent years, a mobile communications technology is quickly developed and the portable terminal or personal digital assistant equipment as represented by a cellular phone has become popular rapidly. Since the portable terminal has become connectable with the Internet, a strong demand has been made by users to enlarge a liquid crystal display device incorporated in the portable terminal apparatus. For this reason, the personal digital assistant equipment of a fold-up or flip type has become widely used. The flip type portable terminal has a body part having operational keys such as ten keys and a lid part that is connected to the body part and provided with a liquid crystal display device.

The portable terminal apparatus is required to be provided with an antenna so as to perform radio communications in connecting with the Internet, etc. Conventionally, a whip antenna has been widely used for the portable terminal apparatus, which can be extended for use and retracted during a time of standby. However, the whip antenna must protrude from the portable terminal apparatus even when the antenna is accommodated in the portable terminal apparatus, which may be a problem in portability. Additionally, the whip antenna is larger in its size than other component parts constituting the portable terminal apparatus, which prevents the portable terminal from being miniaturized. Thus, a built-in type antenna, which is incorporated inside the portable terminal apparatus, has become used (refer to Japanese Laid-Open Patent Application No. 7-221822).

FIG. 1 and FIG. 2 show an antenna built-in type portable terminal apparatus 1 as conventional example. The portable terminal apparatus 1 shown in the figures is a fold-up or flip type cellular phone. FIG. 1 is a perspective view of the portable terminal apparatus 1 viewed from a bottom side. FIG. 2 is a cross-sectional view taken along a line A1-A1 of FIG. 1. It should be noted that an illustration of a lid part is omitted and a body part 2 is illustrated solely in each figure.

As shown in each figure, the body part 2 comprises a housing 4 and an antenna 5, a printed circuit board 6 and electronic parts 7 that are incorporated in the housing 4. The lid part (not shown in the figures) is rotatably attached to the body part 2 by a hinge part 3. Additionally, a speaker 8, electrodes for electric charge and a lid 14 for replacing a battery cell are provided on the bottom of the housing 4.

FIG. 3 is an enlarged view of the antenna 5 incorporated in the portable terminal apparatus 1. Conventionally, the antenna 5 built in the portable terminal apparatus 1 uses a multilayer flexible board, and an antenna wiring 11 formed on a base member 10. The antenna wiring 11, which serves as an antenna, constitutes a helical antenna by being patternized in a spiral shape. Each end of the antenna wiring 11 is extended to a connector part 12, and the connector part 12 is connected to the printed circuit board 6. It should be noted that an opening part 10*a* is formed in a central part of the base member 10 as shown in FIG. 3.

According to the above-mentioned structure, in which the antenna wiring 11 is formed on the single base member 10 and each end of the antenna wiring 11 is extended to the connector part 12, there is a part where the antenna 11 crosses itself as shown in FIG. 3. In FIG. 3, the antenna wiring 11 crosses at the part indicated by the reference numeral 13 (hereinafter, the part where the antenna wiring 11 crosses is referred to as an intersection part 13).

Naturally, the antenna wiring 11 must be insulated so that no short-circuiting occurs at the intersection part 13. For this reason, conventionally, a multilayer flexible board is used so as to form the intersecting parts of the antenna wiring 11 in different layers so as to prevent the antenna wiring from short-circuiting.

The antenna 5 having the above-mentioned structure is stuck on a bottom surface 4*a* of the housing 4 as shown in FIG. 2. The antenna 5 is stuck on the bottom surface 4*a* in a state where the plane of the antenna 5 matches the plane of the bottom surface 4*a*, that is, the antenna 5 and the bottom surface 4*a* are parallel to each other. Moreover, the arranged position of the antenna 5 is determined to be at a part where the density of the electronic parts is small on an individual type of the portable terminal apparatus basis. The arranged position of the antenna 5 is selected to be a side part of the speaker 8 in the example shown in FIG. 1.

However, in the above-mentioned conventional portable terminal apparatus 1, since the planer antenna 5, in which a spiral antenna wiring 11 is formed on the single base material 10, is used, there is a limitation arises in the location of the antenna 5 in the portable terminal apparatus 1. For this reason, it is difficult to locate the antenna 5 with a sufficient communication efficiency, which may affect the communication function of the portable terminal apparatus 1. Moreover, if it is attempted to provide a high communication efficiency to the conventional antenna 5, the antenna may become large, which requires a space to accommodate the enlarged antenna 5. Accordingly, there is a problem that the size of the portable terminal apparatus 1 increases.

SUMMARY OF THE INVENTION

It is a general object of the present invention to provide an improved and useful portable terminal apparatus in which the above-mentioned problems are eliminated.

A more specific object of the present invention is to provide a portable terminal apparatus which improves a communication efficiency while attempting a miniaturization of a housing.

In order to achieve the above-mentioned objects, there is provided according to the present invention a portable terminal apparatus comprising: a housing accommodating component parts therein; an antenna accommodated in the housing; and a battery accommodated in the housing, wherein the antenna is arranged so as to surround the battery.

According to the above-mentioned invention, the antenna can be made with a large loop form by being arranged to surround the battery that has a large size among component parts constituting the portable terminal apparatus. Additionally, although it is necessary to provided a predetermined space to allow the battery to be attached and detached, the antenna can be arranged in the space so as to surround the battery. Thus, if the antenna loop is made large, the portable terminal apparatus can be prevented from being enlarged.

In the above-mentioned portable terminal apparatus, the antenna may be a flexible cable antenna. Accordingly, the antenna can be flexibly deformed in response to the outer configuration since the antenna is formed of the flexible cable. Thus, the antenna can be positively arranged so as to surround the battery even if the space around the battery is small.

Additionally, in the above-mentioned portable terminal apparatus, the antenna may be a flat cable antenna. The flat cable may be arranged so as to be upright to a bottom surface of the housing.

According to the above-mentioned invention, the antenna can be positively arranged in the space surrounding the battery even if the space is small since the flat cable antenna is arranged upright to the bottom surface of the housing. Thus, the portable terminal apparatus is prevented from being enlarged due to arrangement of the antenna. Additionally, the size in a direction of the thickness of the portable terminal apparatus is not increased, even when the flat cable is upright to the bottom surface of the housing, if the width of the antenna is made smaller than the thickness of the battery.

Additionally, in portable terminal apparatus according to the above-mentioned invention, a position defining part may be provided to the housing so as to define a position of the antenna. Accordingly, the flexible antenna can be positively arranged at a specified position by the position defining part, which maintains a predetermined loop form of the antenna without interference with other component parts in the housing.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of a preferred embodiment according to the present invention.

Figure 1:
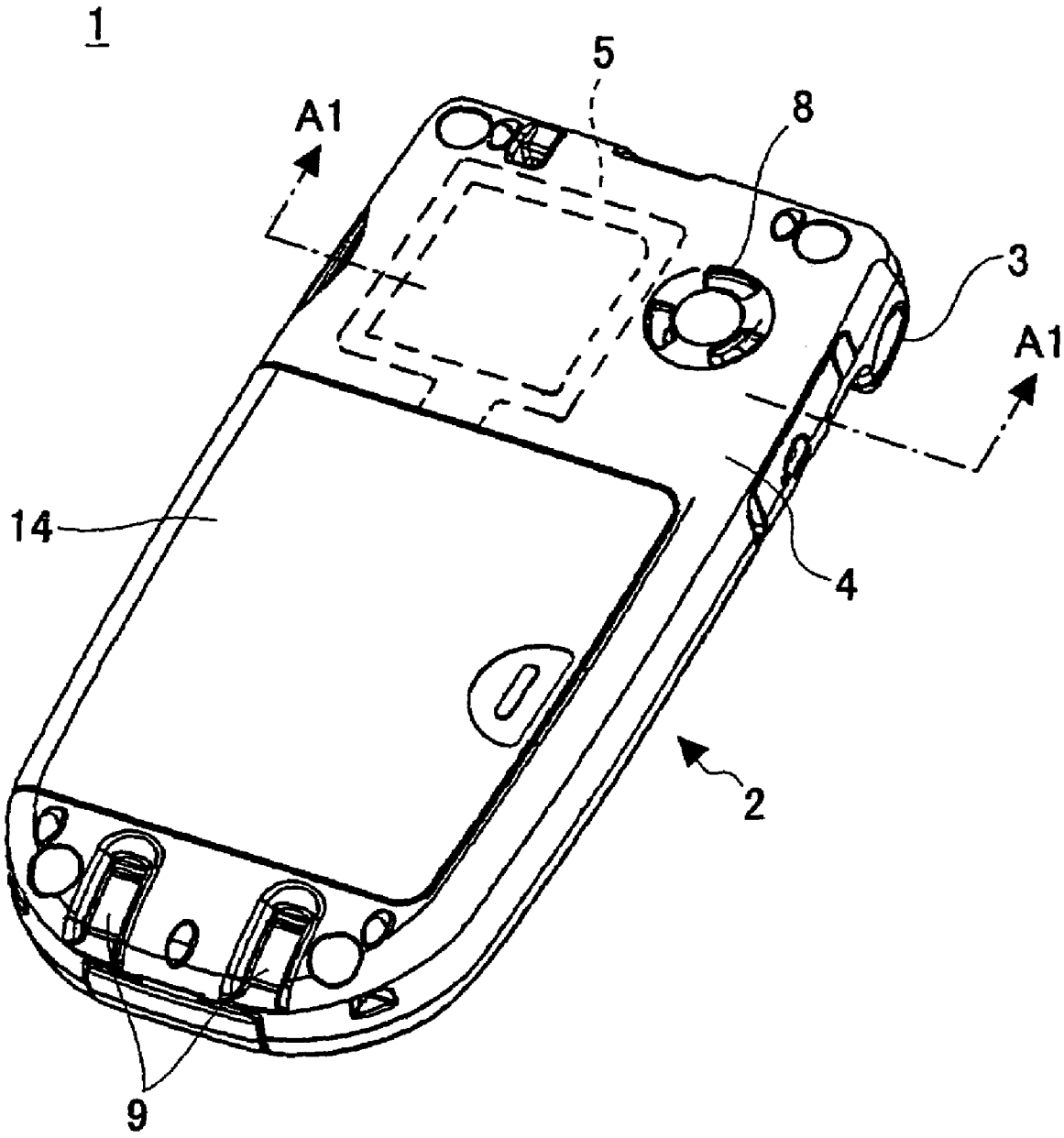
FIG. 1 is a perspective view of a portable terminal apparatus viewed from a bottom side.
Figure 2:
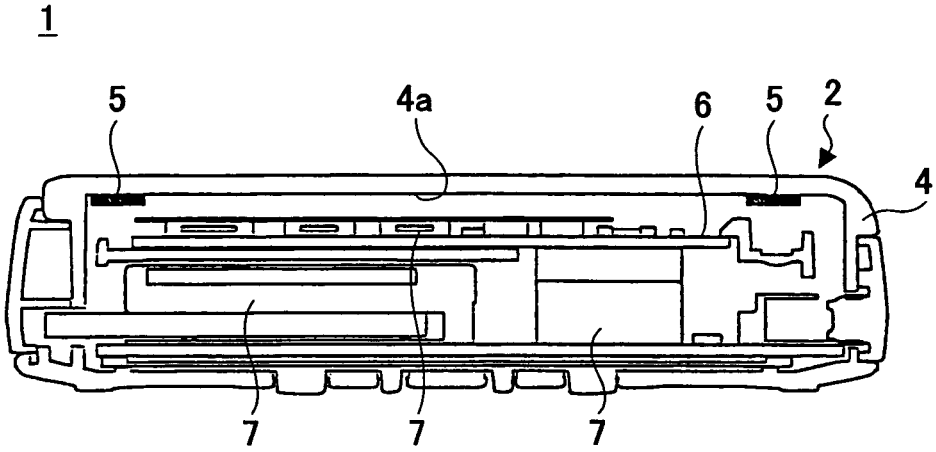
FIG. 2 is a cross-sectional view taken along a line A1-A1 of FIG. 1.
Figure 3:
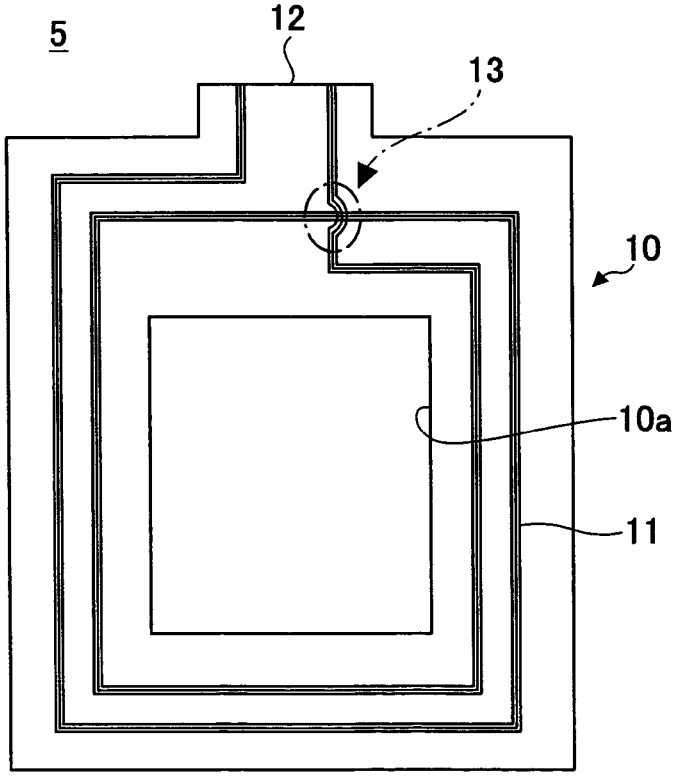
FIG. 3 is an enlarged view of an antenna incorporated in the portable terminal apparatus shown in FIG. 1.
Figure 4:
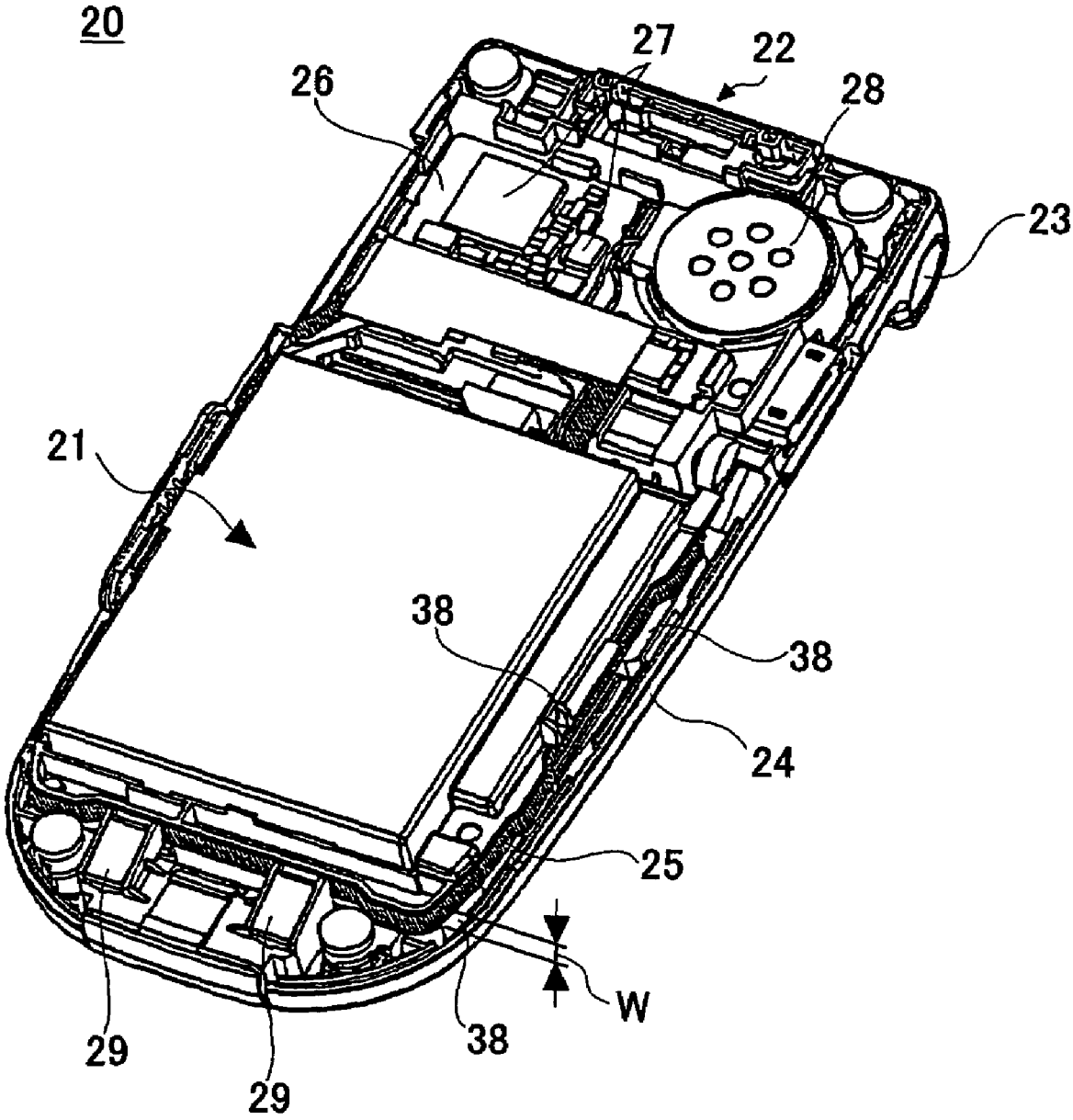
FIG. 4 is a perspective view of a portable terminal apparatus according to an embodiment of the present invention viewed from a bottom side, wherein a bottom plate of a housing is removed so as to show an internal structure.
Figure 5:
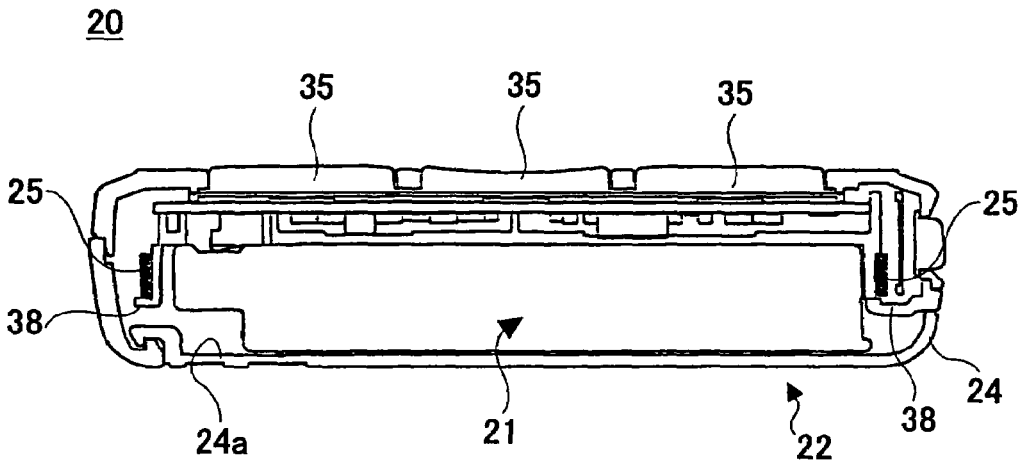
FIG. 5 is a cross-sectional view of a body part, which constitutes the portable terminal apparatus shown in FIG. 4, taken along a line A2-A2 of FIG. 6.
Figure 6:
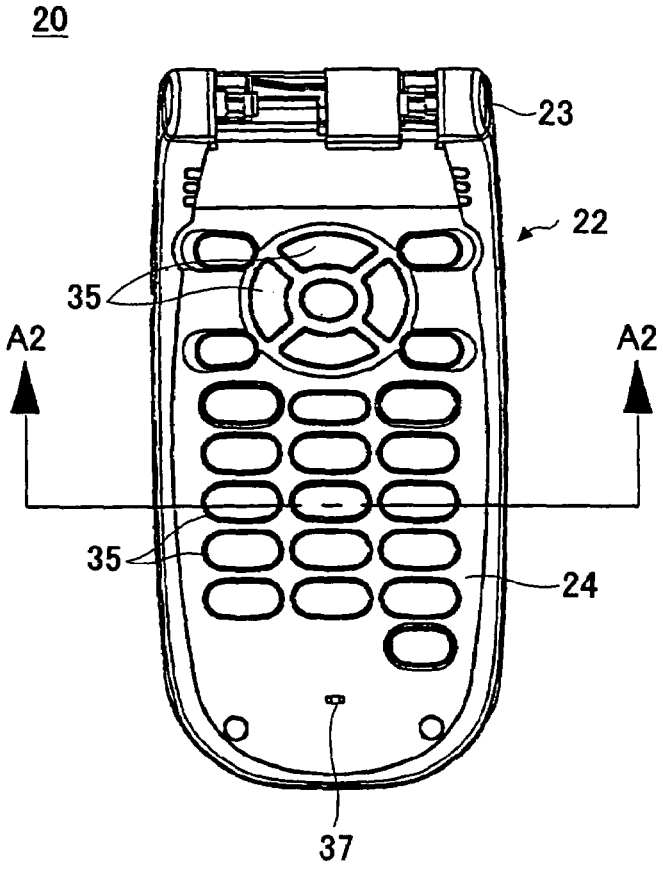
FIG. 6 is a plan view of the body part of the portable terminal apparatus shown in FIG. 4.

FIGS. 4 through 6 show a portable terminal apparatus 20 according to an embodiment of the present invention. The portable terminal apparatus 20 according to the present embodiment is a flip type cellular phone. FIG. 4 is a perspective diagram of the portable terminal apparatus 20 viewed from a bottom side, wherein a bottom plate of a housing 24 is removed so as to show an internal structure. FIG. 5 is a cross-sectional view of a body part 22, which constitutes the portable terminal apparatus 20, taken along a line A2-A2 of FIG. 6. It should be noted that the portable terminal apparatus 20 comprises the body part 22 and a lid part (usually provided with a liquid crystal display device or the like). However, since the present invention relates to the body part 22, an illustration of the lid part is omitted in each figure and the body part 22 is solely illustrated and will be explained.

As shown in each figure, the body part 22 comprises a battery 21, an antenna 25, a multiplayer printed-wiring board 26, electronic parts 27, etc. that are accommodated in the housing 24 which serves as a case. The lid part (not shown in the figures) is rotatably attached to the body part 23 by a hinge part 23. Moreover, a bottom surface 24*a* of the housing 24 is provided with a speaker 28 and electrodes 29 for battery charge. The battery 21 (rechargeable battery) is largest in shape among the component parts provided in the housing 24, as shown in FIG. 4.

The multilayer printed-wiring board 26 is formed so as to avoid the position where the battery 21 is arranged. For this reason, the electronic parts 27, which are mounted on the multilayer printed-wiring board 26, are arranged with high density. Thus, conventionally, there is a limitation occurs in the position where the antenna 5 is arranged. In should be noted that the multilayer printed-wiring board 26 has a multilayer structure in which vias or the link are formed so as to provide intralayer wiring and interlayer wiring.

In the present embodiment, as shown in FIG. 4, the antenna 25 is arranged so as to surround the battery 21. Moreover, a flat cable having flexibility is used for the antenna 25, and a flexible printed wiring board having a wiring pattern formed on one side is used in the present embodiment.

Figure 9:
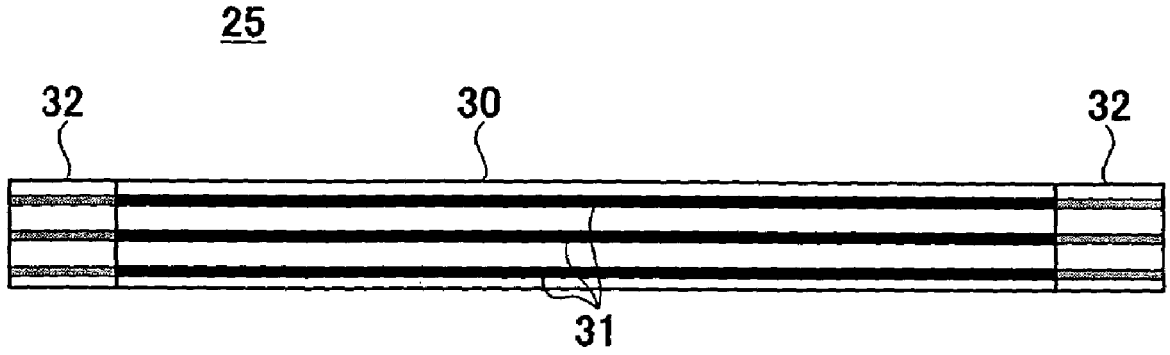
FIG. 9 is an enlarged view of the antenna used in the portable terminal apparatus shown in FIG. 4.

FIG. 9 is an enlarged view of the antenna 25 used in the present embodiment. As shown in FIG. 9, the antenna 25 according to the present embodiment is composed of a plurality of antenna wiring portions 31 formed on one side of a base material 30 made of a plastic. Although opposite ends of the antenna 25 are exposed so that the antenna wiring portions 31 are connectable, other portions of the antenna wiring portions 31 are protected by a protective film.

Here, attention is given to the configuration of the pattern of the antenna wiring portions 31. As shown in FIG. 9, the plurality of antenna wiring portions 31 of the antenna 25 according to the present embodiment are separate from each other (that is, not connected with each other) so as to be parallel to each other. That is, the plurality of antenna wiring portions 31 do not cross with each other on the antenna 25.

Thus, the antenna 25 according to the present embodiment can use the flexible printed board (hereinafter, referred to as a single-layer flexible printed board) on which the antenna wiring portions 31 are formed on one side of the base material 30. With the single-layer flexible printed board, a large cost reduction can be attempted as compared to the conventionally used multilayer flexible printed board. Consequently, a cost reduction in the potable terminal apparatus 20 can be attempted.

Furthermore, the antenna 25 having the flat cable structure is arranged so as to surround the battery 21 in a state where the antenna 25 is substantially perpendicular to the plane of the multilayer printed-wiring board 26 (this is equivalent to a state where the antenna 25 is substantially perpendicular to the bottom surface 24*a* of the housing 24).

According to the above-mentioned structure, there is no need to provide a large space around the battery 21 to arrange the antenna 25 when locating the antenna 25 around the battery 21. Thus, the portable terminal apparatus 25 does not become large even if the antenna 25 is arranged around the battery 21. Moreover, the enlargement of the portable terminal apparatus 20 in a direction of a width of the portable terminal apparatus 20 by setting the width W (indicated in FIGS. 4 and 7) of the antenna 25 within the thickness of the battery 21. Moreover, in the present embodiment, the antenna 25 is arranged so as to surround the battery 21 that is a large part among the component parts constituting the portable terminal apparatus 20. Thus, the antenna 25 can be made with a large loop, which improves antenna efficiency.

Since the antenna 25 is arranged within an open space naturally formed around the battery 21, the portable terminal apparatus 20 does not become larger even if the antenna 25 of such a large loop is provided in the portable terminal apparatus 25. Moreover, since the antenna 25 is flexibly deformable to follow the outer configuration of the battery 21, formation of a dead space near the antenna 25 is prevented, which contributes to the miniaturization of the portable terminal apparatus 20. It should be noted that the open space formed around the battery 21 is a space needed for attaching and detaching the battery 21 to the body art 22.

Furthermore, in the present embodiment, the housing 24 is provided with a position defining part 38, which defined the position of the antenna 25. The position defining part 38 prevents the flexible and easily deformable antenna 25 from being easily deformed in the housing 24. Thus, the antenna 25 can be maintained in a predetermined loop form, which prevents the antenna 25 from interfering with other component parts.

Figure 7:
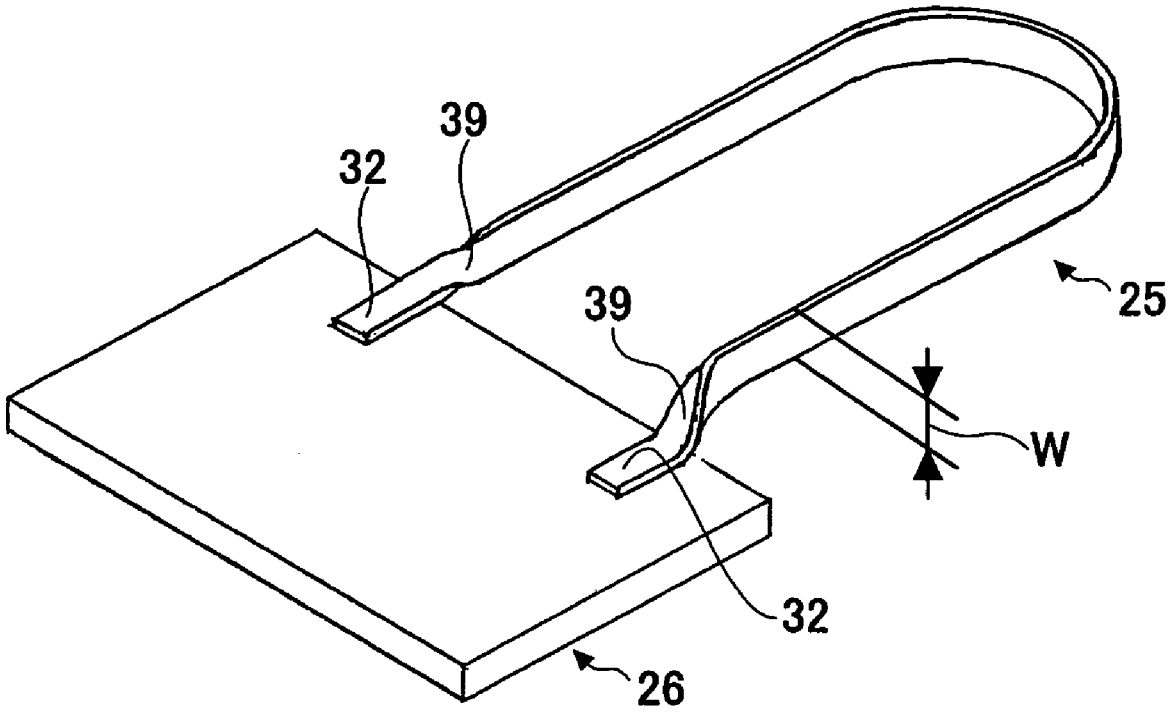
FIG. 7 is a perspective view of an antenna and a multilayer printed-wiring board 26.
Figure 8:
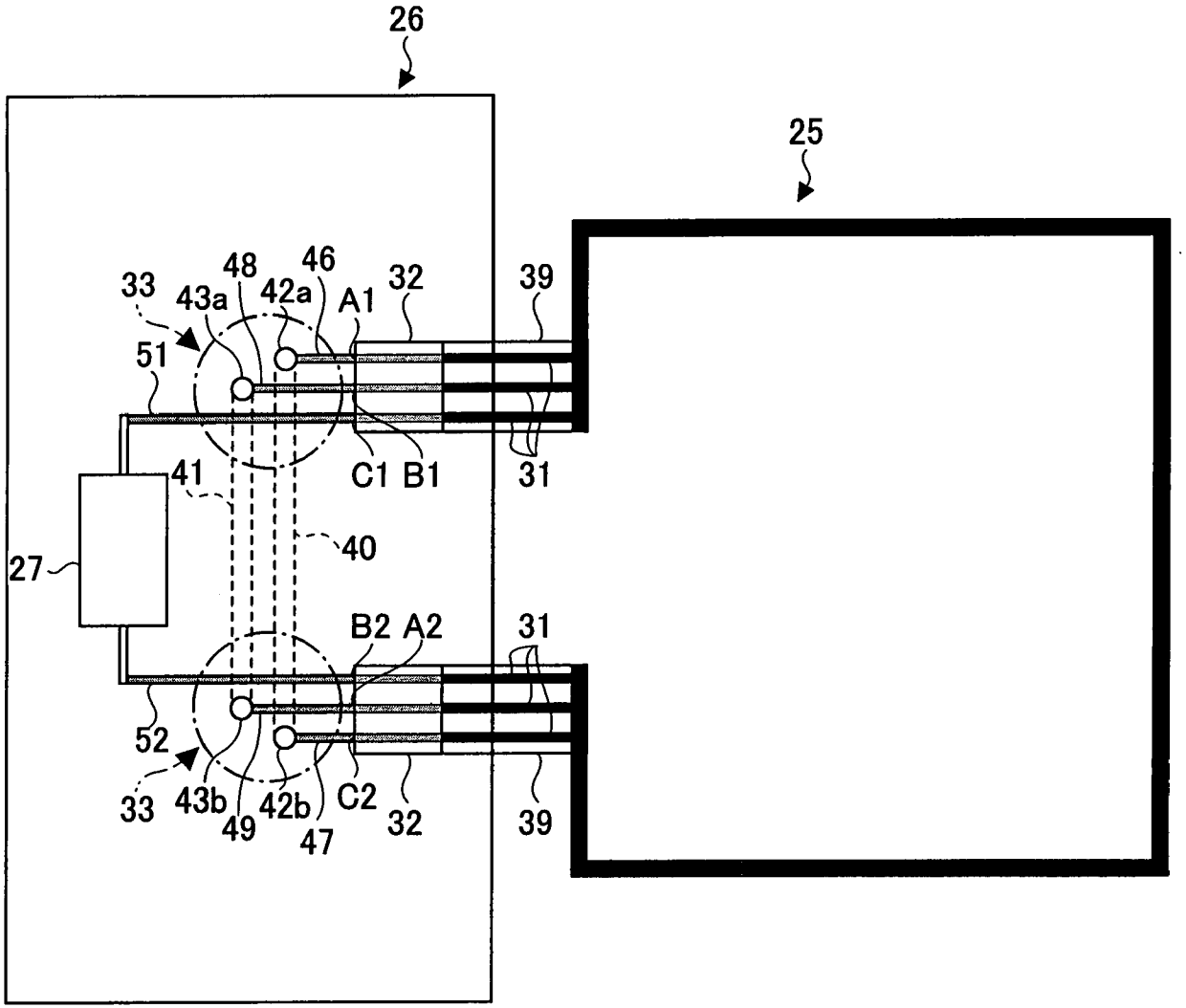
FIG. 8 is a plan view of the antenna and the multilayer printed-wiring board shown in FIG. 7.

FIGS. 7 and 8 shows a connection structure between the antenna 25 and the multilayer printed-wiring board 26. As described above, in the present embodiment, the antenna 25 is arranged upright to the multilayer printed-wiring board 26 (the bottom surface 24*a* of the housing 24) so as to improve the space efficiency of the antenna 25 in the housing 24.

Accordingly, as shown in FIG. 7, twisted portions 39 are provided in the antenna 25 so that the connector portions 32 near the connected portions of the antenna 25 are substantially parallel to the multilayer printed-wiring board 26. Thus, the electric connection between the antenna 25 and the multilayer printed-wiring board 26 can be reliable even if the antenna 25 is upright to the multilayer printed-wiring board 26.

A description will be given more specifically, with reference to FIG. 8, of the connection between the antenna wiring portions 31, which constitutes the antenna 25, and the multilayer printed-wiring board 26.

In FIG. 8, terminals A1, B1, C1, A2, B2, C2 are formed on ends of the antenna wiring portions 31 that constitute the antenna 25, respectively. It should be noted that the electronic parts 27 are semiconductor devices for communications and are connected to the antenna 25.

The terminal A1 of the connector part 32 located at an upper side in FIG. 8 is connected to a via 42*a* through a wiring pattern 46 formed on the multilayer printed-wiring board 26. The via 42*a* is connected to an end of an intralayer wiring 40 formed in an inner layer of the multilayer printed-wiring board 26. Additionally, a via 42*b* is formed on the other end of the intralayer wiring 40, and the via 42*b* is extended to the surface of the multilayer printed-wiring board 26 and is connected to the terminal A2 of the connector part 32 located at a lower side in FIG. 8 through a wiring pattern 47.

The terminal B1 of the connector part 32 located at an upper side in FIG. 8 is connected to a via 43*a* through a wiring pattern 48 formed on the multilayer printed-wiring board 26. The via 43*a* is connected to an end of an intralayer wiring 41 formed in an inner layer of the multilayer printed-wiring board 26. It should be noted that the intralayer wiring 40 and the intralayer wiring 41 are formed in different layers so as to be electrically separated from each other.

Additionally, a via 43*b* is formed on the other end of the intralayer wiring 41, and the via 43*b* is extended to the surface of the multilayer printed-wiring board 26 and is connected to the terminal B2 of the connector part 32 at a lower side in FIG. 8 through a wiring pattern 47. Further, the terminal C1 of the connector part 32 located at a lower side in FIG. 8 is connected to the electronic part 27 through a wiring pattern 51 formed on the multilayer printed-wiring board 26. Additionally, the terminal C2 of the connector part 32 located at a lower side in FIG. 8 is connected to the electronic part 27 through a wiring pattern 52 formed on the multilayer printed-wiring board 26.

Thus, according to the above-mentioned connection structure, the antenna 25, the wiring patterns 46 through 49 and the intralayer wirings 40 and 41 together form a helical antenna.

As mentioned above, in the present embodiment, the antenna 25 is constituted by the plurality of antenna wiring portions 31 that are separated from each other. In order to form the helical antenna by connecting the antenna wiring portions 31 in a loop form, one of the antenna wiring portions 31, the wiring patterns 46 through 49 and the intralayer wirings 40 and 44 must cross each other at one of locations of these parts.

In the present embodiment, intersection parts 33 are formed in the multilayer printed-wiring board 26. That is, in the present embodiment, the intralayer wirings 40 and 41 are formed in the multilayer printed-wiring board 26 and the wiring patterns 47, 48, 51 and 52 are formed so that the intersection parts 33 are formed where the intralayer wirings 40 and 41 cross the wiring patterns 47, 48, 51 and 52. Since the intralayer wirings 40 and 41 are formed in the multilayer printed-wiring board 26, the intralayer wirings 40 and 41 can be formed easily. Moreover, as described above, the multilayer printed-wiring board 26 is used conventionally and is inexpensive as compared to a multilayer flexible board. Therefore, compared with the structure, which forms an intersection part, a portable terminal apparatus 20, can be manufactured simply and cheaply at an antenna 25.

Figure 10A:
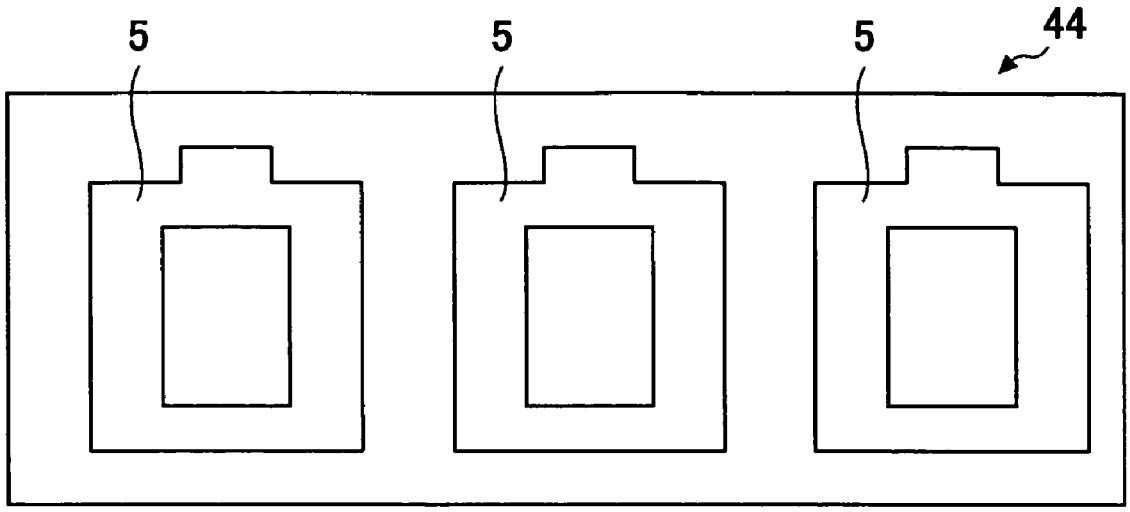
FIG. 10A is an illustration for explaining a manufacturing method of a conventional antenna.
Figure 10B:
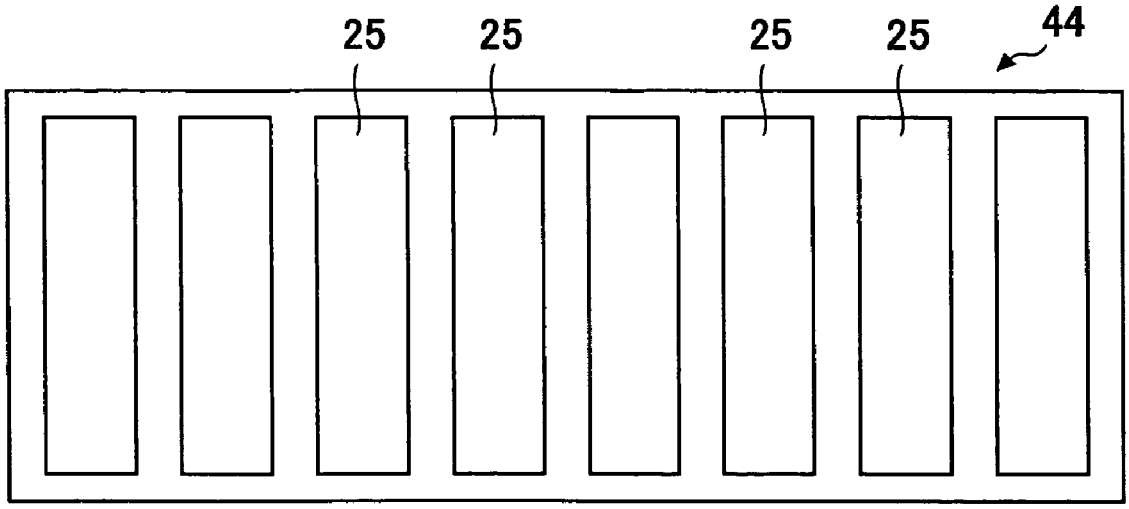
FIG. 10B is an illustration for explaining a manufacturing method of the antenna according to the embodiment of the present invention.

Here, FIG. 10A is an illustration for explaining a manufacturing method of the conventional antenna 5, and FIG. 10B is an illustration for explaining a manufacturing method of the antenna 25 in comparison with the conventional antenna 5. As shown in FIG. 10A, the conventional antenna 5 has the structure in which the helically wound antenna wiring 11 in the base material 10, and, thus, an area of each antenna 5 is large. On the other hand, as shown in FIG. 10B, since the antenna 25 according to the present embodiment has an elongated rectangular shape, and area of each antenna 25 is smaller than that of the conventional antenna 5.

Accordingly, if the antenna 5 and the antenna 25 are formed from a material board 44 having the same size, three conventional antennae 5 are formed as shown in FIG. 10A while eight antennae 25 are formed as shown in FIG. 10B. Therefore, the manufacturing efficiency of the antenna 25 is higher than the manufacturing efficiency of the conventional antenna 5, which results in a cost reduction of the antenna 25.

Figure 11:
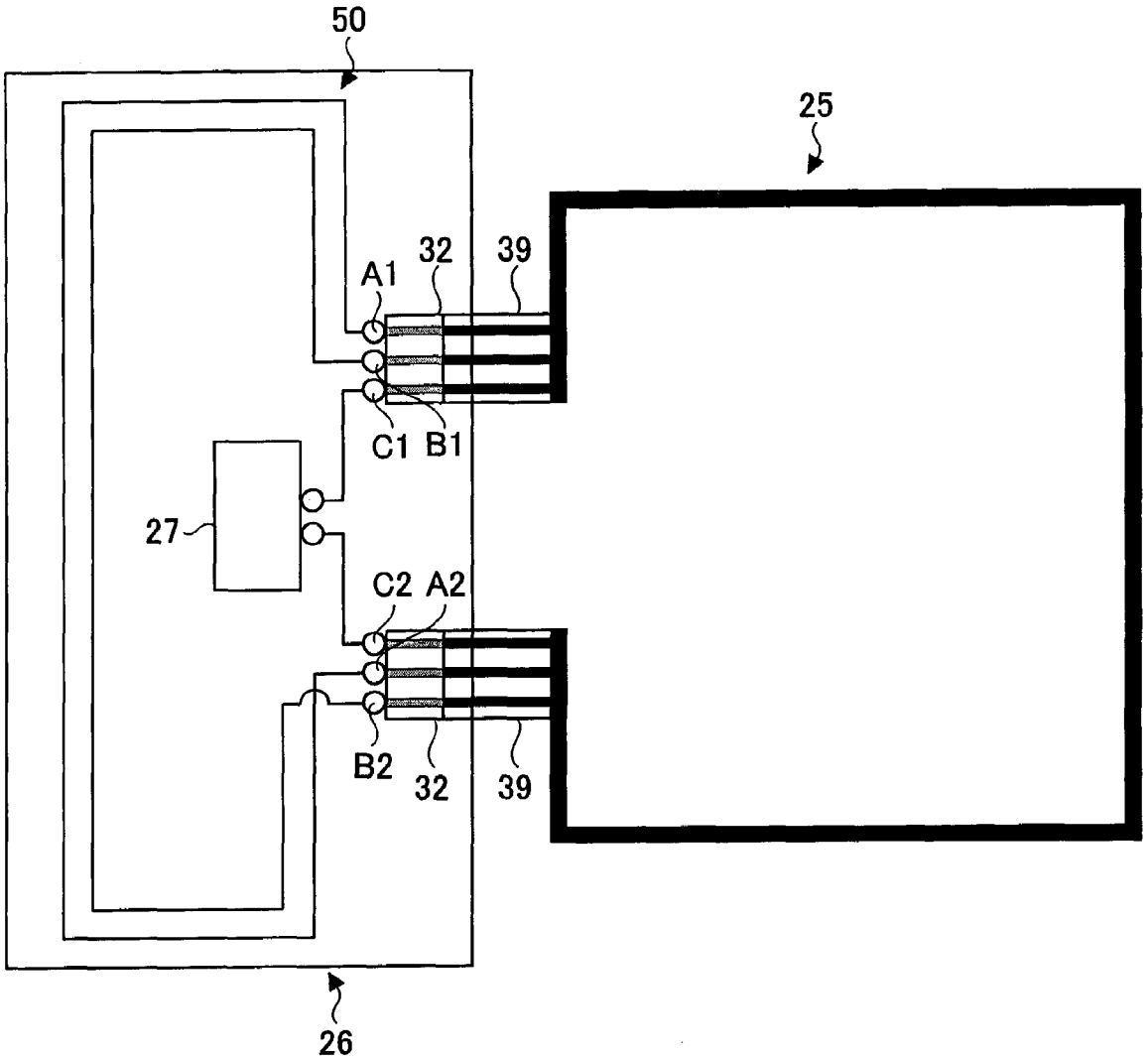
FIG. 11 is a plan view of an antenna structure according to a variation of the embodiment shown in FIG. 4.

FIG. 11 is a plan view of an antenna structure according to a variation of the present embodiment. It should be noted that in FIG. 11, parts that are the same as the parts shown in FIGS. 4 through 10 are given the same reference numerals, and descriptions thereof will be omitted.

The variation shown in FIG. 11 has an antenna pattern 50 that is formed in the multilayer printed-wiring board 26. The antenna pattern 50 is connected to the antenna 25 so as to form a larger antenna pattern. Since the antenna pattern 50 formed in the multilayer printed-wiring board 26 serves as a part of the antenna, an improved efficiency can be achieved as a whole antenna. It should be noted that although the antenna 25 is used as a built-in antenna of the portable terminal apparatus 20, the present invention is not limited to the portable terminal apparatus and is applicable to a non-contact type magnetic induction IC card antenna.

The present invention is not limited to the specifically disclosed embodiments, and variations and modifications may be made without departing from the scope of the present invention.

The present application is base on Japanese priority application No. 2004-114599 filed Apr. 8, 2004, the entire contents of which are hereby incorporated by reference.

What is claimed is:

1. A portable terminal apparatus, comprising:

a housing accommodating component parts therein;

an antenna accommodated in said housing; and a battery accommodated in said housing, wherein said antenna surrounds said battery extending in a vicinity along a periphery of said battery, wherein said antenna is a flexible cable antenna, and wherein a position defining part is provided to said housing so as to define a position of said antenna.

2. The portable terminal apparatus as claimed in claim 1, wherein said flexible cable antenna is a flat cable antenna.

3. The portable terminal apparatus as claimed in claim 2, wherein said flat cable antenna is arranged so as to be upright to a bottom surface of said housing.

4. A portable terminal apparatus, comprising:

a housing accommodating component parts therein;

an antenna accommodated in said housing; and a battery accommodated in said housing, wherein said antenna surrounds said battery extending in a vicinity along a periphery of said battery, wherein said antenna is a flat cable antenna, and wherein a position defining part is provided to said housing so as to define a position of said antenna.

5. The portable terminal apparatus as claimed in claim 4, wherein said flat cable antenna is arranged so as to be upright to a bottom surface of said housing.

* * * * *